US007396213B2

(12) United States Patent
Hugenroth

(10) Patent No.: US 7,396,213 B2
(45) **Date of Patent: *Jul. 8, 2008**

(54) OIL UTILIZED AS MOTOR PROTECTOR TRIP FOR SCROLL COMPRESSOR

(75) Inventor: Jason Hugenroth, Lafayette, IN (US)

(73) Assignee: Scroll Technologies, Arkadelphia, AR (US)

( * ) Notice: Subject to any disclaimer, the term of this patent is extended or adjusted under 35 U.S.C. 154(b) by 607 days.

This patent is subject to a terminal disclaimer.

(21) Appl. No.: 10/862,497

(22) Filed: Jun. 7, 2004

(65) Prior Publication Data

US 2004/0223862 A1 Nov. 11, 2004

Related U.S. Application Data

(63) Continuation of application No. 10/235,212, filed on Sep. 5, 2002, now Pat. No. 6,848,889, which is a continuation-in-part of application No. 09/690,275, filed on Oct. 17, 2000, now Pat. No. 6,485,268.

(51) Int. Cl.
*F04B 49/10* (2006.01)
*F01M 9/00* (2006.01)

(52) U.S. Cl. ..... 417/13; 184/6.1; 184/6.16

(58) Field of Classification Search ..... 417/13, 417/228, 231, 230; 184/6.1, 6.4, 6.16
See application file for complete search history.

(56) References Cited

U.S. PATENT DOCUMENTS 4,349,149 A * 9/1982 Humpert ..... 137/100
4,823,593 A * 4/1989 Furlong et al. ..... 128/204.24
5,651,342 A * 7/1997 Hara ..... 123/339.1
6,059,540 A * 5/2000 Ni ..... 417/228
6,125,642 A * 10/2000 Seener et al. ..... 184/103.1
6,161,563 A * 12/2000 Mankins ..... 137/15.07
6,212,699 B1 * 4/2001 Tremblay ..... 4/363
6,280,146 B1 * 8/2001 Bush et al. ..... 417/13
6,302,654 B1 * 10/2001 Millet et al. ..... 417/228
6,318,638 B1 * 11/2001 Banno et al. ..... 236/12.2

(Continued)

FOREIGN PATENT DOCUMENTS

EP 0822335 A3 4/1998

(Continued)

OTHER PUBLICATIONS

International Search Report, dated Jan. 21, 2004.

*Primary Examiner*—Charles G Freay
(74) *Attorney, Agent, or Firm*—Carlson, Gaskey & Olds

(57) ABSTRACT

A scroll compressor has lubricant flow which communicates lubricant onto a motor protector when adverse conditions are present causing the motor protector to trip the motor and stop further rotation. The lubricant is returned to an oil sump through a normal return path. The normal return path outlet may be positioned above the motor protector such that lubricant will contact the motor protector when adverse conditions are present, or the outlet may be remote from the protector. When the outlet is remote from the protector, a funnel and tubing divert the oil to the motor protector under adverse conditions. Alternatively, a passage communicating with the normal return path is selectively blocked when an adverse condition is present. At that time, lubricant is forced into an alternative oil path, which is positioned above the motor protector.

4 Claims, 4 Drawing Sheets

U.S. PATENT DOCUMENTS 6,485,268 B1 11/2002 Hugenroth
6,848,889 B2 * 2/2005 Hugenroth ..... 417/228

FOREIGN PATENT DOCUMENTS

EP 1130265 A3 5/2001
JP 9126177 A 5/1997
JP 09126177 A * 5/1997

* cited by examiner

OIL UTILIZED AS MOTOR PROTECTOR TRIP FOR SCROLL COMPRESSOR

RELATED APPLICATIONS

This application is a continuation of U.S. patent application Ser. No. 10/235,212, filed Sep. 5, 2002 now U.S. Pat. No. 6,848,889, which was a continuation in part of U.S. patent application Ser. No. 09/690,275; filed Oct. 17, 2000 now U.S. Pat. No. 6,485,268.

BACKGROUND OF THE INVENTION

This invention relates to a system which optimizes the flow of a lubricant over portions of a scroll compressor which become hot during reverse rotation or loss of charge, and then selectively passes the heated lubricant onto a motor protector under certain conditions.

Scroll compressors are becoming widely utilized in refrigerant compression applications. In a scroll compressor, a first scroll member has a base and a generally spiral wrap extending from the base. The wrap of the first scroll member interfits with the wrap from a second scroll member. The second scroll member is caused to orbit relative to the first, and refrigerant is entrapped between the scroll wraps. As the second scroll members orbits, the size of the compression chambers which entrap the refrigerant are reduced, and the refrigerant is compressed.

There are certain design challenges with a scroll compressor. As an example, while the scroll compressor efficiently compresses refrigerant when rotated in a proper forward direction, there are undesirable side effects if the scroll compressor is driven to rotate in a reverse direction. Moreover, if the level of refrigerant or charge level being passed through the compressor is lower than expected, there may also be undesirable side effects. Among the many undesirable side effects is an increased heat level at the scroll compressor members.

One safety feature incorporated into most sealed compressors is the use of a motor protector associated with the electric motor for driving the compressor. The same is true in a scroll compressor, wherein a motor protector is typically associated with the stator for the electric motor. The motor protector operates to stop rotation of the motor in the event there is an electrical anomaly, or if the motor protector senses an unusually high temperature. However, the problems mentioned above with regard to reverse rotation and loss of charge typically cause heat to increase at the compressor pump set which is relatively far from the motor. Thus, it may take an undue length of time for the additional heat being generated in the compressor pump set to pass to the motor protector.

SUMMARY OF THE INVENTION

In the disclosed embodiment of this invention, lubricant is caused to flow over a motor protector of a compressor pump set in sufficient quantities to cause the motor protector to trip the motor and stop further rotation when adverse conditions are present in the compressor pump set.

In one general type of embodiment of the disclosed invention, the lubricant is directed to a normal return path wherein the lubricant passes over a heated portion of the compressor before returning to an oil sump. In this type embodiment, lubricant is directed to the motor protector only if adverse conditions are present. Some automatic feedback, such as the refrigerant volume flow, achieves the selective control. In preferred embodiments, the heated portion of the compressor over which the lubricant is passed is the non-orbiting scroll. Alternatively, in some embodiments the heated lubricant can pass over the orbiting scroll. In a second general type embodiment of the disclosed invention, the flow of lubricant back to the motor protector is selective, and will only occur if adverse conditions are present. In this type of embodiment, the normal return path does not include the motor protector. Instead, a passage communicating with the normal return path is selectively blocked when an adverse condition is present. At that time, lubricant is forced into an alternative oil path, which is positioned over the motor protector.

These and other features can be best understood from the following specification and drawings, the following which is a brief description.

DETAILED DESCRIPTION OF PREFERRED EMBODIMENTS

Figure 1:
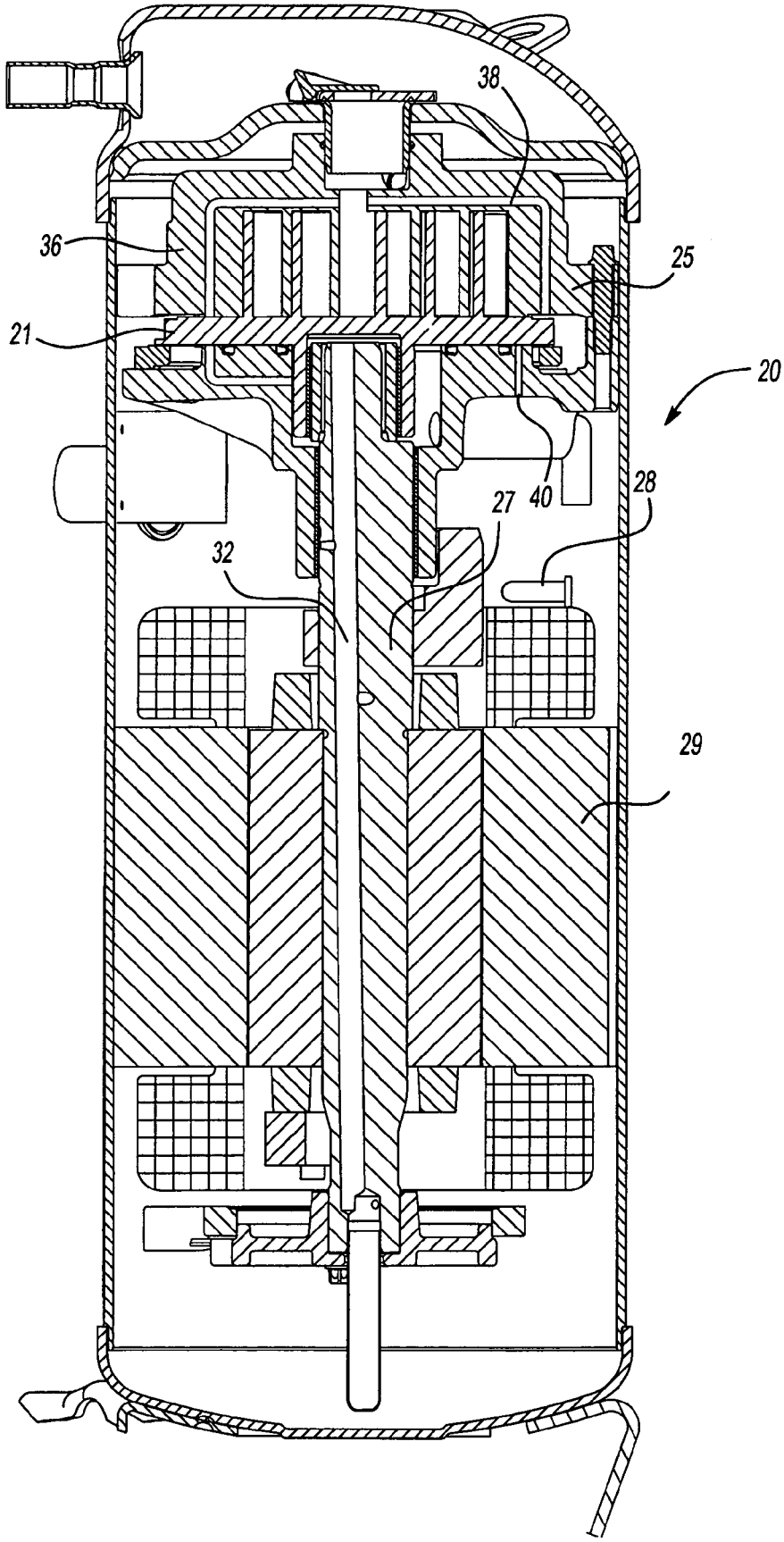
FIG. 1 is a cross-sectional view through a scroll compressor pump set.

FIG. 1 shows a cross-section of a scroll compressor 20 having a compressor pump set which incorporates an orbiting scroll 21 and a non-orbiting scroll 25. This is a schematic view of one embodiment from the parent application. A motor protector 28, as known, is associated with a motor stator 29. A lubricant level (not shown) is positioned beneath the motor. An oil feed tube 32 extends through drive shaft 27. Downstream fluid flow portions 36 and 38, shown schematically, pass over the non-orbiting scroll 25. An outlet 40 returns the heated lubricant to the lubricant sump. While FIG. 1 depicts the oil feed obtained directly from the sump, the oil feed may also be obtained from elsewhere as known in the art.

In a first general type of embodiment of the present invention, the feed tube 32, downstream portions 36, 38, and outlet 40 comprise a normal oil return path wherein, under normal conditions, the oil does not contact motor protector 28. However, lubricant 42 is directed to the motor protector 28 if adverse conditions are present.

FIGS. 2 through 6 show a first type embodiment of the disclosed invention wherein the normal return path avoids the motor protector 28. Under normal operating conditions, the lubricant 42 passes over a heated portion of the compressor before returning to the oil sump as above. While a minimal amount of oil 42 may contact the motor protector 28 under normal operating conditions, the amount is insufficient to activate the motor protector 28. As will be explained, under adverse running conditions, the lubricant 42 is directed to the motor protector 28 to trip the motor protector 28 and stop further rotation of the motor.

Figure 2:
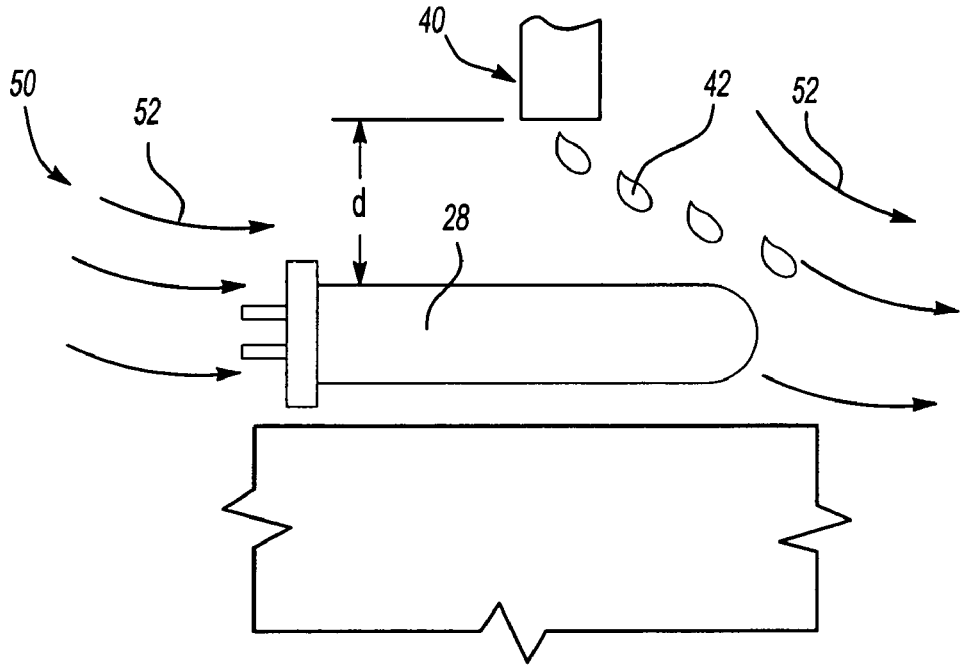
FIG. 2 is a cross-sectional view of a first embodiment compressor.

In a first embodiment 50, the oil 42 is returned toward the motor protector 28 but only trips the motor protector 28 under adverse conditions which significantly decrease the mass flow rate of refrigerant (represented by arrows 52) through the compressor pump set 22. During normal operation, the refrigerant rotates through the pump set 22 in the same direction as the drive shaft 27, carrying oil 42 exiting from the outlet 40 so that it does not contact the motor protector 28, other than in small amounts, as shown in FIG. 2. Adjusting distance d ensures that the oil 42 does not contact the motor protector 28 during normal operation. However, should mass flow of refrigerant within the pump set 22 drop due to adverse conditions such as loss of charge or indoor fan failure, the lower mass flow rate will allow the oil 42 to drip onto the motor protector 28, thereby stopping further rotation of the motor. That is, the mass flow rate of refrigerant 52 will be lower such that heated oil contacts the protector 28 in greater quantities. One advantage of this embodiment 50 is the decreased amount of time it takes to trip the motor protector 28 after adverse conditions are realized. While some motor protection systems require the reduced mass flow in the system to heat the oil, and then that the heated oil contact the protector, this embodiment relies solely on the reduced mass flow of the system to trip the protector.

Figure 3:
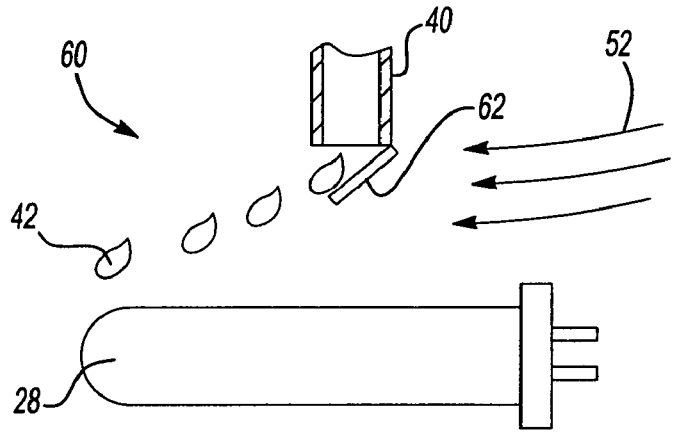
FIG. 3 is a cross-sectional view of a second embodiment compressor.
Figure 4:
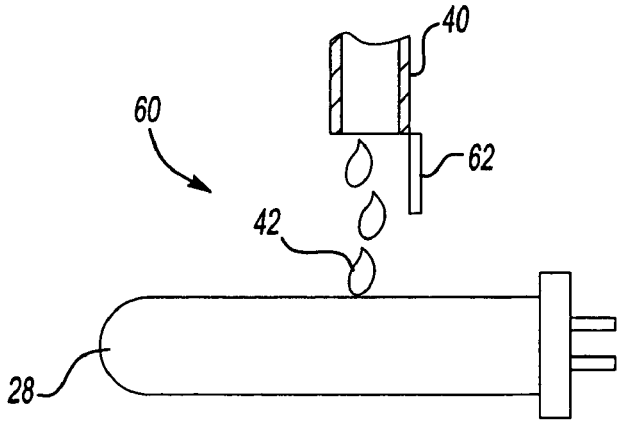
FIG. 4 is another cross-sectional view of the second embodiment compressor.
Figure 5:
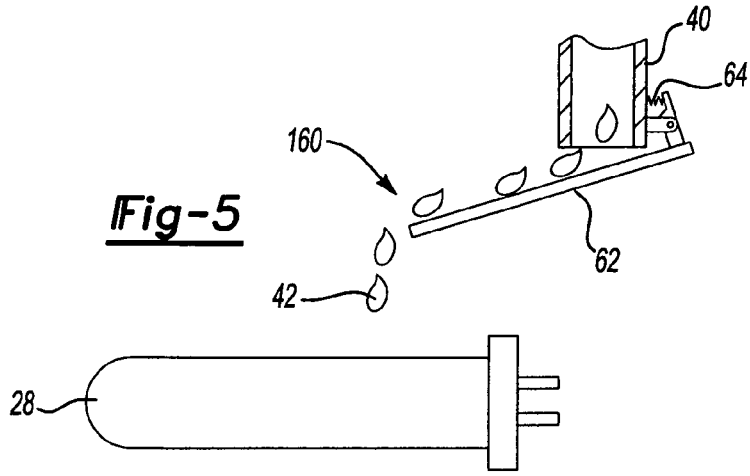
FIG. 5 is a cross-sectional view of a third embodiment compressor.

FIGS. 3 and 4 show a second embodiment 60 which also relies on the mass flow rate of the refrigerant to trip the motor protector 28. In this embodiment, a diversion flap 62 is located at outlet 40. During normal operating conditions, the mass flow rate of the refrigerant pushes the flap 62 to partially block the outlet 40 and redirect the oil 42 such that it does not contact the protector 28, as shown in FIG. 3. As with embodiment 50, when the mass flow rate of the refrigerant slows due to an adverse condition, the flap 62 returns to a non-deflecting position, allowing the oil 42 to trip the motor protector 28. The flap 62 may be substantially vertical when in the non-deflecting position, requiring placement of the outlet 40 substantially above the protector 28, as shown in FIG. 4. In another embodiment, 160, the flap 62 may be biased toward the motor protector 28 in the non-deflecting position using a spring 64 or other biasing means, allowing placement of the outlet 40 some distance from the motor protector 28 as shown in FIG. 5.

Figure 6:
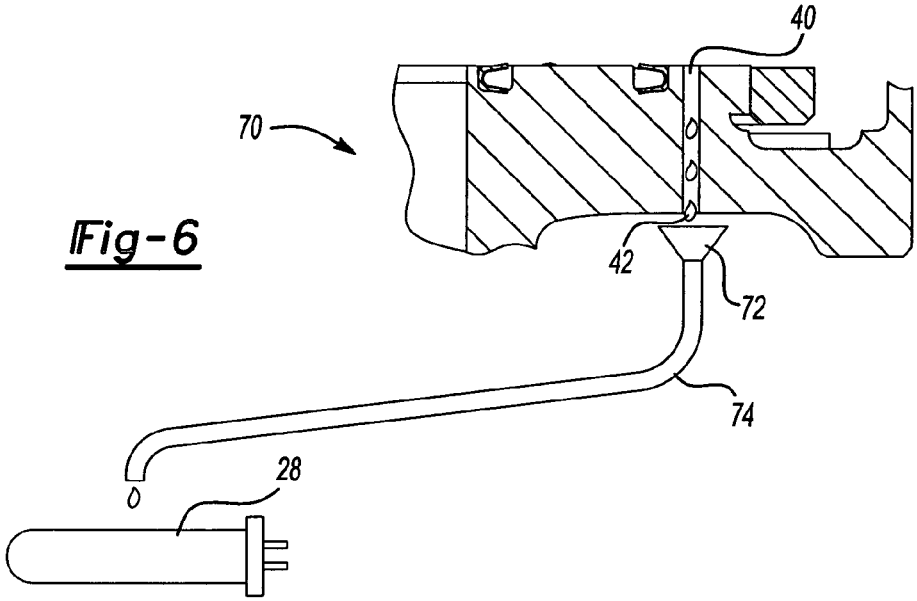
FIG. 6 is a cross-sectional view of a fourth embodiment compressor.

FIG. 6 shows a further embodiment 70 of the present invention wherein a funnel 72 captures oil 42 from the outlet 40 and directs it toward the motor protector 28 much like the diversion flap 62 described above. A tube 74 attached to the funnel 72 diverts the oil 42 toward the motor protector 28. The diverter mechanism can be utilized to take the return oil 42 and move it circumferentially such that it is in the proper position relative to the motor protector 28. Alternatively, this diverter concept can be utilized to move oil completely independent of any protection feature. The funnel concept allows the incorporation of the movement of the oil circumferentially without the necessity of redesign of housing or compressor pump unit detail.

Figure 7:
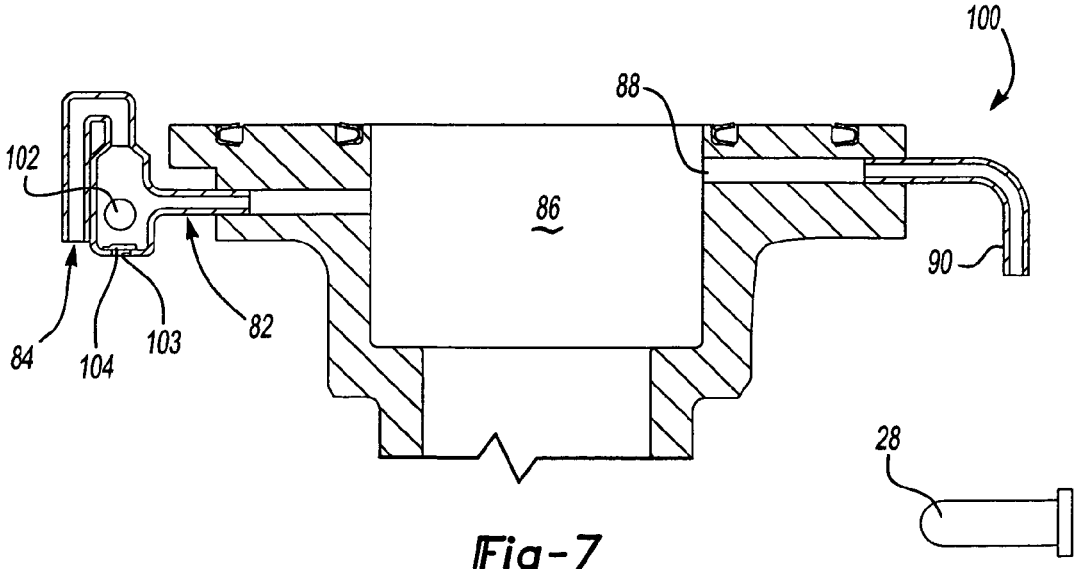
FIG. 7 is a cross-sectional view through a fifth embodiment compressor.

FIGS. 7 through 11 show the second general type of embodiment of the present invention. As shown in FIG. 7, a normal oil return path does not include the motor protector 28. Instead, a passage 82 communicates with a normal oil return path tube 84. Oil will return from passage 82 back downwardly through tube 84 under normal operating conditions, avoiding the motor protector. Communication between the passage 82 and the tube 84 is selectively blocked when an adverse condition is present. At that time, oil 42 within a chamber 86 will no longer move into the passage 82. The lubricant 42 will then be forced upwardly into a passage 88, and from the passage 88 it will communicate with an alternative oil path. An alternative oil return tube 90 is positioned over the motor protector 28, thereby tripping the motor protector 28 to stop further rotation of the motor. Positioning the orbiting scroll (not shown) closer to the alternative passage 88 than to the normal passage 82 will ensure that better heat transfer is achieved. As with the first general type of embodiment, a funnel or other means may be used to direct the oil 42 from the alternative oil return tube 90 to the motor protector 28.

The FIG. 7 embodiment 100 has a float ball 102 which floats in the oil returning through the passage 82. An opening 103 in the passage 82 allows some oil 42 to escape the passage 82, thereby preventing the ball 102 from floating high enough to block the passage 82. When the oil becomes excessively heated during an abusive running condition, a bimetal clip 104 snaps to cover the opening 103, increasing the amount of oil in the passage 82 and forcing the ball 102 upwardly to close communication between the passage 82 and the tube 84. At that time, oil is forced into the alternative oil passage 88 to trip the motor protector 28 as described above.

Figure 8:
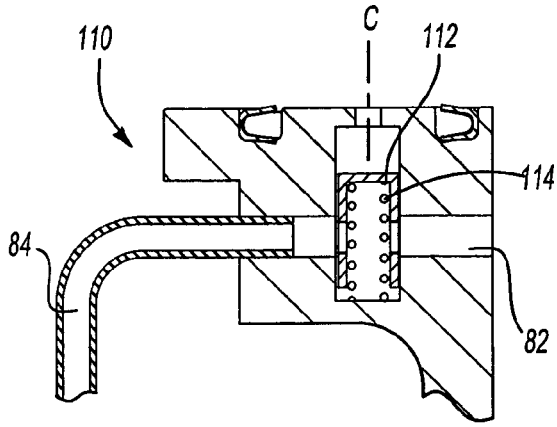
FIG. 8 is a modification to the FIG. 7 embodiment.

FIG. 8 shows embodiment 110, wherein the passage 82 includes a piston 112 with an associated spring 114 that selectively closes the passage 82 when an adverse condition is present. Under normal operating conditions, intermediate pressure from a compressor chamber C compresses the spring 114 such that the piston 112 remains depressed, thereby allowing oil 42 to flow through passage 82 and downwardly through tube 84. During adverse running conditions which tend to cause intermediate pressure to drop, such as indoor fan failure, the spring 114 releases and the piston 112 moves upwardly to block communication between passages 82 and 84. When this occurs, the oil is forced through the alternative oil path to trip the motor protector 28 as described above. A worker in this art would recognize how to provide communication to an intermediate pressure chamber.

Figure 9:
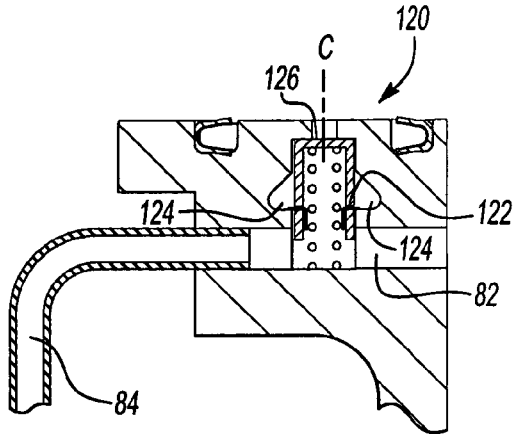
FIG. 9 is another modification to the FIG. 7 embodiment.

FIG. 9 shows embodiment 120 which only slightly differs from embodiment 110. In embodiment 120, bimetal clips 122 positioned in mating grooves 124 maintain a piston 126 in an upward position allowing oil 42 to flow through the passage 82 and downwardly through the tube 84. When the compressor pump set 22 becomes heated to a predetermined temperature during adverse running conditions, the clips 122 snap clear of the grooves 124. This allows intermediate pressure to drive the piston 126 to move downwardly, blocking communication between passages 82 and 84. Similar to previous embodiments of this type, oil is then forced through the alternative oil path to activate the motor protector 28 and stop rotation of the motor.

Figure 10:
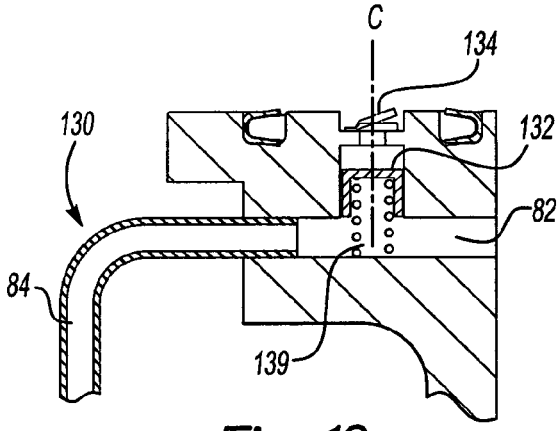
FIG. 10 is yet another modification to the FIG. 7 embodiment.

FIG. 10 shows embodiment 130, wherein a piston 132 associated with a spring 139 selectively closes passage 82. Suction pressure is communicated both below and above the piston 132. The spring 139 thus maintains the piston in an upward position, allowing passage 82 to communicate with oil return tube 84. A bimetal clip 134 covers an opening in the passage 82 above the piston 132 which communicates with intermediate pressure at C. The clip 134 normally blocks intermediate pressure from reaching the piston 132. When an adverse running condition causes the temperature to exceed a predetermined level, the clip 134 snaps allowing intermediate pressure to contact the piston 132 forcing it downwardly to block communication between passage 82 and tube 84. At this time, oil 42 is forced through the alternative oil path to trip the motor protector 28 as described above.

Figure 11:
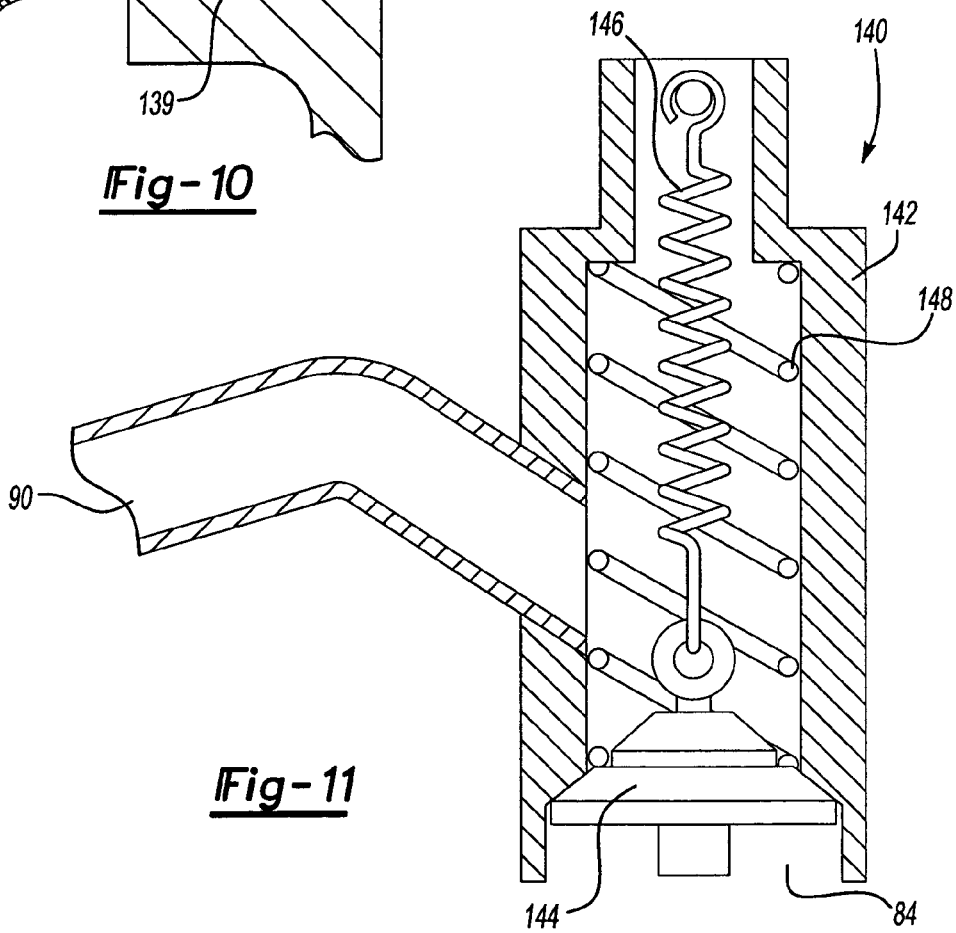
FIG. 11 is a cross-sectional view through yet another embodiment.

FIG. 11 shows another embodiment 140 of the present invention, wherein a mechanism 142 connects the oil return passage 82 and the normal oil return tube 84. A plug 144 selectively closes communication between the passage 82 and the tube 84 by blocking access to the tube 84. The plug is attached to a shape memory alloy spring 146 housed within the mechanism 142. As this spring 146 increases in temperature, it contracts in length or size. A second spring 148 applies a biasing force to hold the spring 146 in a predetermined position under normal operating conditions, thereby preventing the plug 144 from blocking the tube 84. However, should adverse running conditions cause the oil 42 flowing through the mechanism 142 to become sufficiently heated, the spring 146 will contract. As the spring 146 contracts in size, it overcomes the force from the spring 148 and the plug 144 attached to the spring 146 is pulled to block tube 84. At that time, the lubricant 42 within the mechanism 142 will no longer exit through the tube 84. Instead, the lubricant 42 will be forced to exit the mechanism 142 through the alternate oil path return tube 90, thereby tripping the motor protector 28 to stop rotation of the motor. This embodiment differs from the embodiments in FIGS. 7 through 10 largely in the fact that the passage 82 leads directly to both the normal oil return tube 84 and the alternative oil return tube 90 through the mechanism 142.

It should be understood that while the invention has been disclosed for reacting to a predetermined high temperature or loss or gain of pressure within the compressor pump set, other conditions could cause the actuation. Although preferred embodiments of this invention have been disclosed, a worker in this art would recognize that certain modifications would come within the scope of this invention. For this reason, the following claims should be studied to determine the true scope and content of this invention.

The invention claimed is:

1. A scroll compressor comprising:

a compressor pump unit having a first scroll member having a base and a generally spiral wrap extending from said base, a second scroll member having a base and a generally spiral wrap extending from said base, said spiral wraps of said first and second scroll members interfitting to define compression chambers, and a crankcase for supporting said second scroll member;

a shaft for driving said second scroll member to orbit relative to said first scroll member, and compression chambers between said wraps of said first and second scroll member decreasing in size as said second scroll member orbits to compress an entrapped refrigerant;

a motor for driving said shaft to cause said second scroll member to orbit, said motor having a rotor and a stator, and a motor protector associated with said motor stator, said motor protector being operable to stop further operation of said motor;

a sensing mechanism for actuating said motor protector when a predetermined amount of lubricant contacts said motor protector; and an unblocked oil return passage extending through said crankcase in a direction having a major component in a vertical direction, said oil return passage being positioned to be generally over said sensing mechanism to allow oil to fall freely from said compressor pump unit under all conditions.

2. A scroll compressor as recited in claim 1 having a normal mass flow of refrigerant through said compressor pump unit under conditions other than an undesired condition, said normal mass flow being sufficient to carry lubricant exiting from said oil return passage away from said sensing mechanism such that said lubricant does not contact said sensing mechanism in sufficient quantities to actuate said motor protector.

3. A scroll compressor as recited in claim 2, wherein said undesired condition is a decreased mass flow rate, thereby allowing lubricant to contact said motor protector in sufficient quantities to actuate said motor protector.

4. A scroll compressor as recited in claim 1, wherein said direction is vertical.

* * * * *